United States Patent [19]

Loix

[11] Patent Number: 4,655,319

[45] Date of Patent: Apr. 7, 1987

[54] FOLDING LADDER

[76] Inventor: Gilbert Loix, rue Bourgogne 20, Wihogne, Belgium

[21] Appl. No.: 814,102

[22] Filed: Dec. 27, 1985

[30] Foreign Application Priority Data

Jan. 18, 1985 [BE] Belgium ..... 901523
Dec. 11, 1985 [BE] Belgium ..... 0/215993

[51] Int. Cl.[4] ..... E06C 9/12
[52] U.S. Cl. ..... 182/96; 182/160
[58] Field of Search ..... 182/96, 95, 159, 160, 182/161, 162

[56] References Cited

U.S. PATENT DOCUMENTS 314,899 3/1885 Wilson ..... 182/96
350,047 9/1886 Dunn ..... 182/96
3,517,770 6/1970 Loix ..... 182/96
4,425,983 1/1984 Reinhard ..... 182/96
4,489,807 12/1984 Rodriguez ..... 182/96

*Primary Examiner*—Reinaldo P. Machado
*Attorney, Agent, or Firm*—Darby & Darby

[57] ABSTRACT

The invention concerns improvements to a folding ladder consisting of two angle section uprights arranged facing one another, of which the surfaces perpendicular to the plane of the ladder carry two longitudinal ribs provided with facing perforations, receiving pivots for articulating rungs to enable them to be folded. Three essential points are improved: holding the ladder to the wall, the electric release system for opening the ladder, the correct placement of the system of release of the ladder at the different vertical points from which the whole ladder can be directed manually or electrically to open.

12 Claims, 14 Drawing Figures

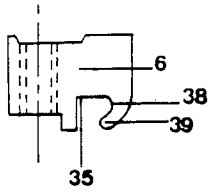
FIG.4
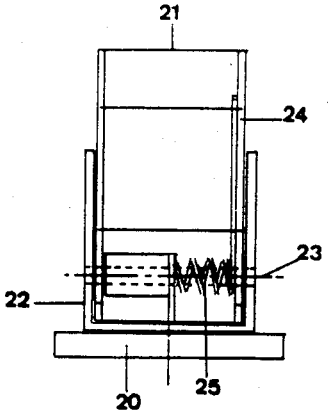
FIG.5
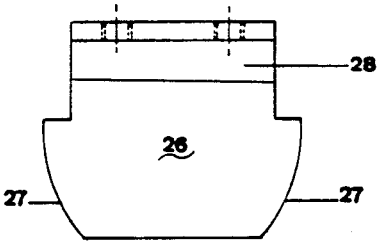
FIG.6
FIG.7
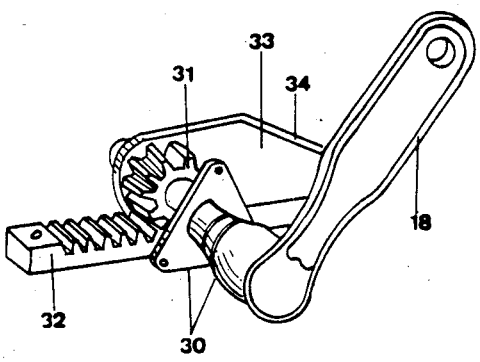
FIG.8
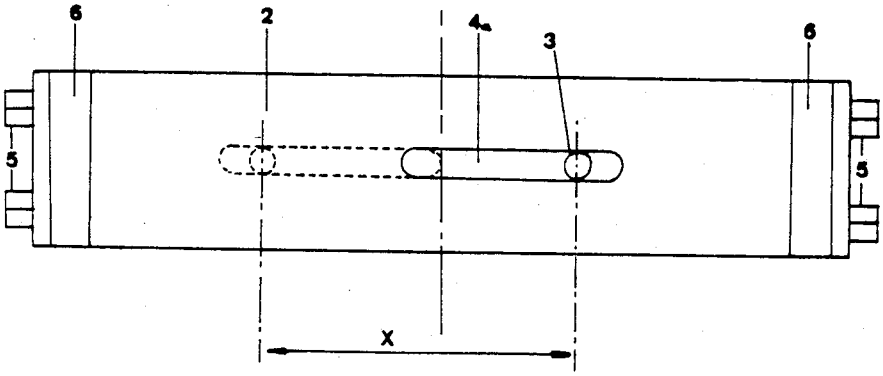

FOLDING LADDER

The invention relates to improvements to a folding ladder comprising two sectional angle metal uprights arranged facing one another, the faces of which are perpendicular to the plane of the ladder and have two longitudinal ribs provided with facing perforations which receive pivots for articulating rungs in such manner as to be able to fold by bringing the uprights together.

In this type of ladder, there is a need to improve four essential points which have not so far been entirely resolved:

1. Holding the ladder to the wall;
2. the releasing system for opening the ladder;
3. the correct placement of the system of ladder release at the different vertical levels at which its total opening may be controlled;
4. the automatic deployment of the ladder and guard rail using a manual or electrical system actuated by a release even if the axes or grips of the other releases are at rest.

It is consequently necessary to allow for the fact that, when placing such folding ladder in caissons of determinate length, it is necessary, when the facade is higher than the height of a single caisson, to place two or more caissons one above the others in order to equal or exceed the height of the facade to be equipped with such folding ladder.

Such caissons should be interconnected so as to form only one integral whole or folding ladder and to make it possible to open such ladder as a whole from different heights, for example opposite each exit giving access to the ladder. It is therefore important that detachment of the retaining pieces of the mobile upright and the distance of the latter from the fixed upright should be guaranteed at all vertical points on the ladder where they are fitted. One of the conditions is perfectly to align the different successive caissons forming the ladder in the vertical plane and to keep them aligned.

It is therefore essential to have adjustable retaining ladder ties capable of meeting such conditions allowing for the fact that it is not possible to hope that the facade of the building constitutes a perfect vertical plane. Moreover, any pulling or pushing force exerted vertically or horizontally on the uprights or the rungs of the ladder may not be allowed to detach the ladder from the retaining ties which hold it.

Another condition of achieving a maximum guarantee of sound operation of the different ladder opening releases derives from correct placement at the required points when fitting the ladder to the building. To this end, it is essential to arrange on the spot on the one hand, all the pre-established places where an axis and a release support can be positioned on the fixed upright of the ladder and, on the other hand, all the pre-established places where the toothed rail of the same release can be placed on the detachment control batten of the mobile upright.

This invention remedies the inconveniences and resolves the aforesaid essential points by allowing for the possibility of expansion of the ladder components due to temperature variation, without creating areas subject to tensions possibly causing deformation of the ladder at certain points. The invention further provides for the possibility of opening the ladder by anelectrical system control by push-buttons placed at the different exits giving access to the ladder and further of combining the electrical system of opening with the manual. In case of failure of one of the releases, the ladder can be made to open either by using another release or electrically, by using the electric device provided to this end.

Another characteristic of the release is the fact that, when a hand grip is operated, the latter causes the corresponding pinion to turn, moving its toothed rail, which is an integral part of the flat unit acting as a batten, a flat unit on which another toothed rail has been fixed at each floor, each toothed rail placed on such flat or batten acts upon its corresponding pinion without nevertheless causing the related axis and handgrip to pivot, which means that the act of operating the arm of the release is independent of the movement of the other release arms.

The improvement in accordance with this invention made in folding emergency ladders of one or more successive vertical elements, of which each element is made up of two angle-metal uprights arranged with their interior surfaces facing one another, of rungs articulated upon the said uprights; uprights of which the inside surfaces perpendicular to the plane of the ladder respectively carry two longitudinal ribs located towards the edge of the wing of the first upright and towards the angle of the second upright, such ribs each facing a rib of the other upright and provided, at regular intervals in the longitudinal direction, with facing perforations receiving pivots for articulating the rungs, characterized by the fact that the fixed angled upright, that is the one to be placed on the facade side, includes, on the one hand, on each side, externally and laterally, a wing parallel to the plane of the facade; a wing, over which on either side are flanged units having a groove engaging with the edge of such lateral wings. The latter are shaped in such a way as to penetrate into the throat of the groove on each unit which is fixed by means of one or more bolts at a desired point along the length of the parallel longitudinal slots with which each of the wings of a U-shaped unit anchored to the facade is provided; an anchored unit gripping and holding by its wings the fixed upright by means of grooved units and, on the other hand, the fact that such said fixed upright has within it, between its wing perpendicular to the facade and the adjacent rib, a double hammerhead-shaped slot into which can be slid the edges of a batten of length identical to that of a section of the ladder. Such batten in each section is intended to be linked to the next in such a way as to ensure continuity and connection over the whole height of the ladder of the means of keeping it in the folded and deployed position, and by means of successive perforations, make it possible to broach a toothed rail at determinate points to place a release, for example, every 30 cm. Points likewise determined on the lateral wing of the fixed upright by successive perforations intended to receive a drilling gauge to effect perforations for fixing the support of the axis of the release.

In addition, in order to ensure smooth functioning of the succession of battens, pinions and toothed rails facilitating the attachment, detachment and separation of the two uprights of the ladder, a reinforcing support is provided which, fitting into the centre rib opposite the perpendicular side wing of the fixed upright and attached by screw or bolt, will be able to act as a pivot bearing for the axis of the release, prevent deformation of the side wing of the fixed upright and, for this reason, effective meshing of the pinion with the toothed rail.

In accordance with another preferred form of embodiment of the invention, in order to ensure the functioning of the succession of battens, pinions and toothed rails facilitating attachment, detachment and separation of the two uprights of the ladder, instead of a reinforcing support fitting into the side slot on the centre rib, a reinforcing support can be provided which does not slot into the side slot of the centre rib but which fits only into a throat similar to those in expansion pieces having a groove which is attached to the inside edge of the side wings of the U-piece. Such reinforcing support has a hole which acts as a bearing to the axis of the pinion on the toothed rail, and is held in place by means of two grooves, one on each side of the piece.

In order better to understand the invention and bring out its characteristics, it will now be described in an illustrative and non-restrictive manner with reference to attached drawings as follows:

FIG. 1 is a simplified sectional view into the caisson of the folding ladder, showing the expansion pieces;

FIG. 1*a* is a view of the detail contained in the circle marked with a dotted line in FIG. 1, such detail being designed in accordance with another preferred form of embodiment;

FIG. 1*b* is a simplified partial sectional view of the same caisson at the level of a reinforcement piece;

FIG. 1*c* is a view of the detail contained in the circle marked with a dotted line in FIG. 1*b*, such detail being designed in accordance with another preferred form of embodiment;

Figure 3:
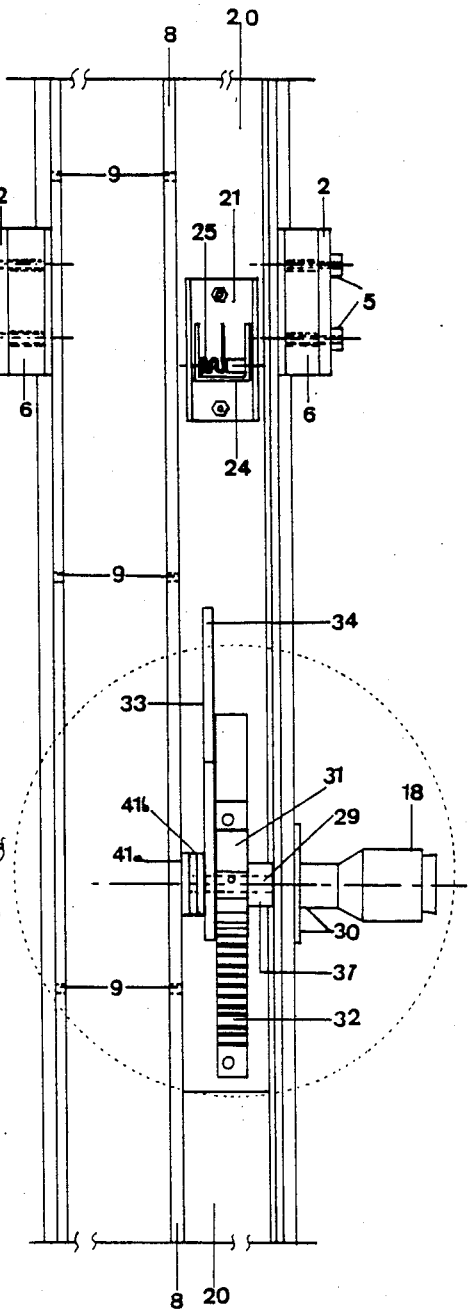
FIG. 3 is a scaled-down view, partly cut away, of the side of a caisson section.
Figure 3A:
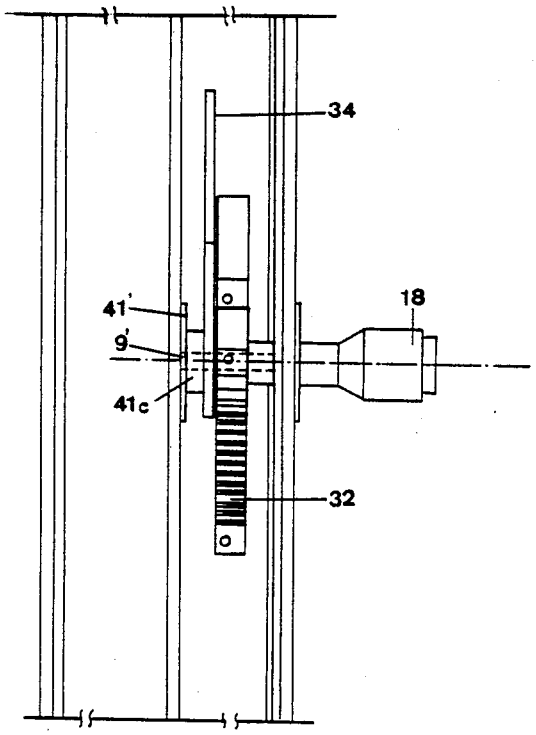
Figure 9:
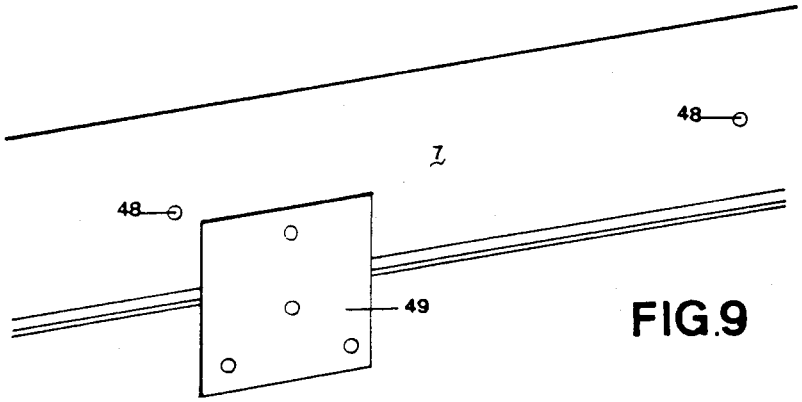
Figure 10:
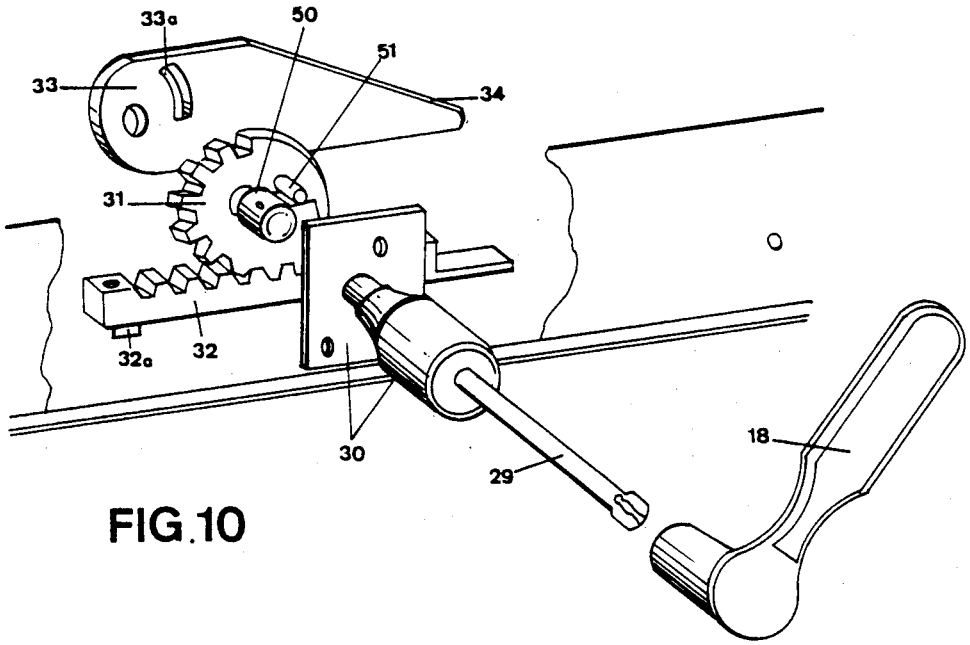

FIG. 3*a* is a view of the detailed contained in the circle marked with a dotted line in FIG. 3 according to another form of embodiment;

FIG. 4 is a side view of the expansion piece;

FIG. 5 is a view of the attachment piece provided on the fixed upright;

FIG. 6 is a view of the attachment piece provided on the upright to be unfolded;

FIG. 7 is a simplified profile view of the release;

FIG. 8 is a partial rear view of the anchoring unit;

FIG. 9 is a view of the two items provided for releasing the ladder invention;

FIG. 10 is a curaway overall view of the items provided for releasing the ladder invention.

Figure 1A:
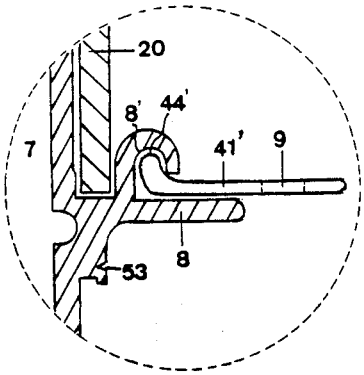
Figure 1:
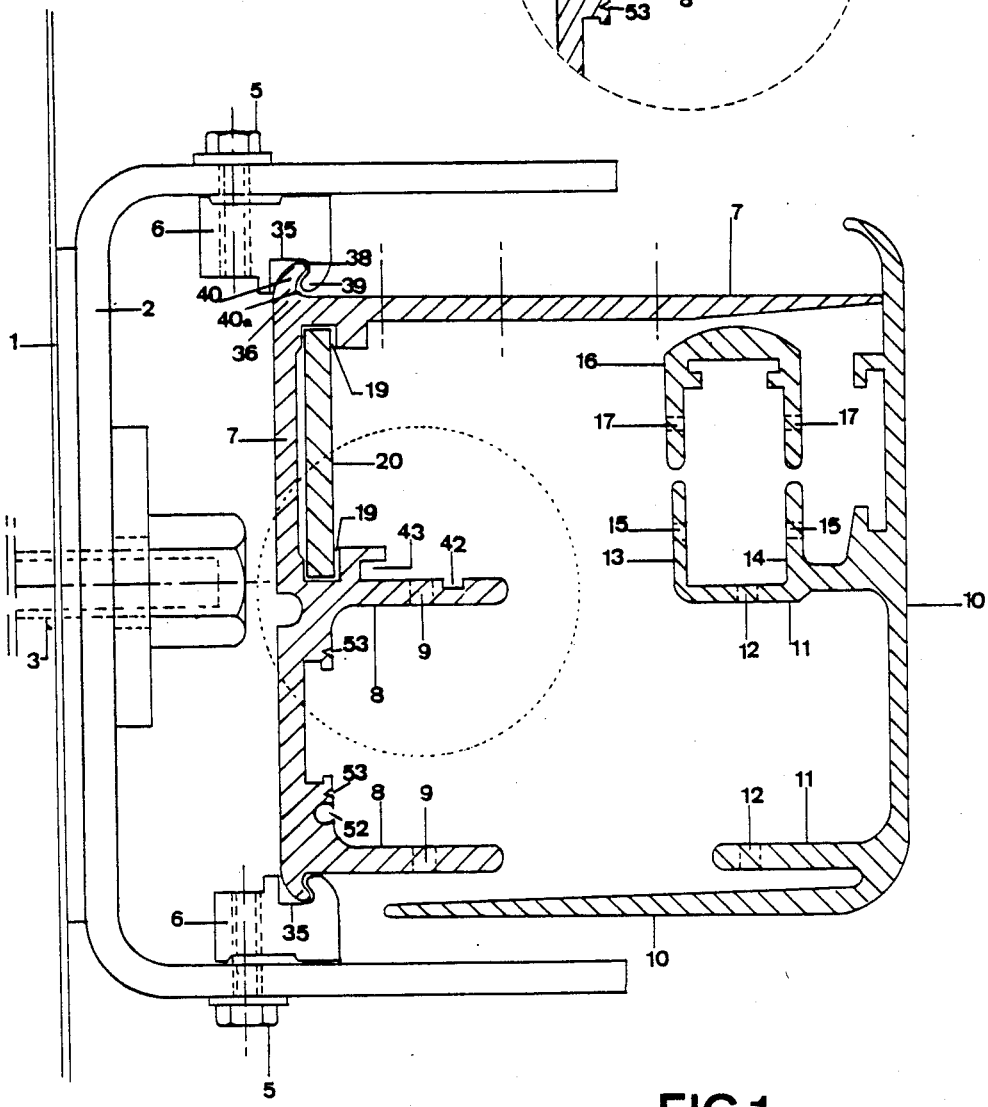
Figure 1B:
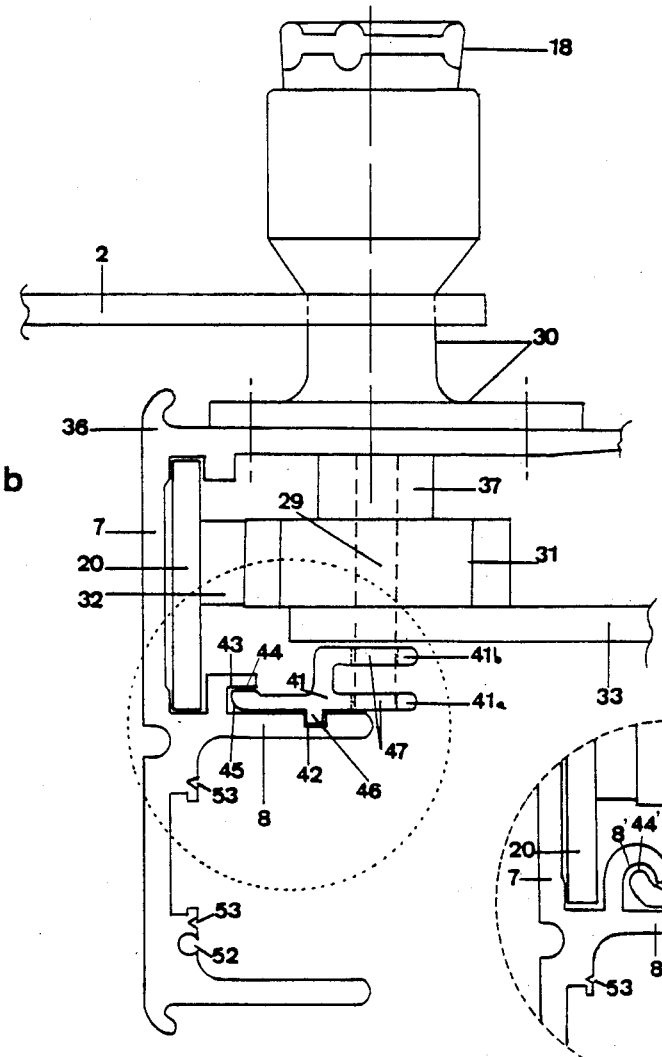

Referring to FIGS. 1 and 1*b*, 1 represents the facade of a building, 2 is a U-piece anchored by an expansible bolt 3, the back of the U-piece having an adjusting slot (FIG. 8) before final fixing to the wall and each of the wings having two longitudinal slots 4 through which pass the two bolts 5 holding the pieces 6 which hold and, for expansion reasons for example, allow to slide vertically, the fixed angle-metal upright 7 of the ladder including longitudinal ribs 8 provided with perforations 9 for the pivots of the rungs (not shown). The slot in the U-piece 2 (FIG. 8) is off-centre in relation to the axis in such a way as to permit maximum lateral displacement (X) giving good vertical alignment of all the expansion pieces 6 even if the bolt anchoring to the building should be moved laterally owing, for example, to the presence of an iron bar.

In FIG. 1 is also shown the unfolding angle upright 10 which, when closed, forms the caisson with the fixed upright. Such unfolding upright 10 likewise includes longitudinal ribs 11 facing the ribs 8 of the fixed upright 7. In such unfolding upright 10, there are perforations 12 for the pivots of the rungs (not shown). In known manner, one of the ribs 11 of the unfolding upright 10 has longitudinal legs 13 and 14 in which perforations 15 are provided for the guard-rail pivots (not shown). Facing such legs 13 and 14 is shown a section 16 forming the opposite upright of the guard rail (not shown); section 16 also including perforations 17 for the pivots of the guard rail (not shown).

FIG. 1*a* shows the rib 8 in accordance with another preferred form of embodiment of the invention. The rib 8 does not have the slots 42 and 43. This last slot 43 has been replaced by a groove 8' into which fits the nose 44' of the support 41' which is held in place by a notch made on either side of the latter on the groove 8' by a chisel; this support has a hole 9' acting as support to the axis 29 passing through the pinion 31 of the toothed rail 32. Adjacent to this support 41' there is a thick washer 41*c* acting as a distance-piece. Such distance-piece 41*c* prevents warping of the support 41'.

FIGS. 9 and 10 show a diagram of the opening system and in particular an opening handle 18 to be found at different levels on the ladder facing each exit point, such as a window. The perforations 48 make every 30 cm on the wing of the fixed upright 7 perpendicular to the facade are already provided. Such perforations, with the help of a drilling gauge 49 attached by bolts to one of such perforations 48, make it possible to effect placement at that point of the support 30 of the axis 29 and hence of the other items forming the release.

If assembling the successive sections of the ladder results from all of the following arrangements : positive connection of the fixed uprights 7 to the facade 1 through the intermediary of the U-pieces 2 and indirect connection of the movable (unfolding) uprights 10 through the intermediary of the rungs (not shown) and the fixed uprights 7, it is essential to be able at the same time to keep each movable part of each section on the corresponding fixed part but likewise to be able to free the ladder as a whole at different heights. To this end, a direct connection is provided for attachment and detachment. Accordingly, the inside face of the fixed upright 7 includes, between the wing perpendicular to the fixed upright 7 and the adjacent rib 8, a double longitudinal slot 19 into which is slid a flat piece 20 acting as a batten, the height of such flat piece being identical to that of a section of the ladder. Flat piece 20 which is connected, for example, by means of a small plate and two screws (not shown) to the flat pieces 20 of the section above and below, if any. To this flat piece 20 (FIG. 1) is affixed an attachment piece 21 (FIGS. 3 and 5) and the system is controlled by flat piece 20 through the release arm 18; attachment piece 21 consisting of a U-section 22 with its back turned towards the flat piece 20, through which is placed an axis 23 bearing a bracket 24 face downwards and pressed by a spring 25 into this position. Facing such attachment piece 21 forming an integral part in the vertical plane of the fixed upright 7 is a piece 26 (FIG. 6) provided with a nose 27 and fixed to the movable upright 10, a nose 27 which engages under the bracket 24 when the ladder is closed. Such piece 26 is generally fixed into the centre rib 13 of the unfolding upright 10, the rear part 28 of this piece is vertically recessed in such a way that the nose 27 is more or less in the centre longitudinal axis of the flat piece 20. It will therefore be readily understood that, when the ladder is closed, to enable it to open, the nose 27 should no longer be held by the bracket 24 and that it is necessary to raise the latter and therefore the flat piece 20; which is effected by lowering the release arm 18. To achieve this, such arm or hand-grip 18 (FIGS. 1*b*, 3, 7, 10) is mounted at one end of an axis 29 placed in a support 30 fixed on the side wing of the upright 7, axis 29 passing through such upright and sustained at the other end by a reinforcing support 41, localized and fixed laterally by the slots 42 and 43 on the rib 8 and localized and fixed longitudinally by a bolt. On the axis 29 is fixed the control button 50 which acts upon the pin 51 of the pinion 31 causing the latter to turn, which forces the toothed rail 32 tailed into the plate 20 by means of two pins 32*a* upwards and hence the bracket 24 on the attachment piece 21. In order to force unfolding of the ladder, a longitudinal tilting or ejector arm 33 has also been placed on the axis beyond the pinion 31 and controlled by the pin 51, which pushes, when its angle end 34 gets further away from the flat piece 20, against the centre rib 13 of the movable upright 10.

In order to ensure that all the attachment pieces 21 placed on the flat pieces 20, which form an integral whole, may be raised and thus detach pieces 26 fixed on the movable upright 10 before the tilting arm 33 forces the movable upright 10 to distance itself from the fixed upright 7, a curved slot 33*a* has been made on the flat part of the tilting arm 33, allowing the pin 51 lodged in this slot to pivot through several degrees before pulling the tilting arm 33 and bringing about the unfolding of the ladder over its whole height. In the same way, when operating the hand grip of the release, the latter causes the pinion 31 to turn, which pulls the toothed rail 32 and moves it. This toothed rail is fixed to the flat piece 20 acting as a batten. A toothed rail 32 placed on this flat piece or batten 20 is to be found on each floor, acting upon its corresponding pinion without however causing its connected axis 29 and hand-grip to rotate, which means that, when one operates the hand-grip 18 of the release, its movement is independent of the movement of the other arms of the other releases.

Moreover, when the ladder opening operation is carried out and the hand-grip 18 is freed, all the attachment pieces 21 and the flat pieces 20, forming an integral whole, are brought back to their point of departure, this is, downwards, by a traction spring (not shown) fixed at the bottom of the fixed upright 7 on the one hand and on the batten 20 on the other.

In order that it should be possible, on the one hand, easily to mount the toothed rail on the flat piece 20 without nevertheless lifting the flat piece 20 from the fixed upright 7, and, on the other hand, easy to localize it at the right point on the flat piece 20 so that the pinion 31 of the release is correctly meshed for the operation of opening the ladder, double perforations are provided on the flat piece at all points along its length where it is possible to place a release. To do it, this toothed rail 32, is pinned on the flat piece 20 by the pins 32*a* before mounting the other pieces of the release. Moreover, this toothed rail can no longer be un-pinned from the flat piece 20 when the other pieces of the release areput in place.

In order to ensure a connection between the pieces 6 and the fixed uprights 7 (FIGS. 1, 3 and 4), the notches 35 in the pieces 6 include, on one side, a rounded groove 38 into which will fit the rounded nose 40 corresponding in shape to the small lateral wings 36 of the fixed uprights 7. Because the notches include a groove 40*a* of course, the remainder of the side will have the shape of a rounded nose 40. The same will apply to the corresponding side of the lateral wings 36 which will have a shape matching the rounded groove. By providing for a certain clearance between the respective dimensions of the grooves 38 and 40*a* of piece 6 and the noses 40 and grooves 38 of the wings 36, it will be easy to place the pieces 6 on the wings 36, indeed the pieces 6 are brought at an angle to the wings 36, then the pieces 6 will be straightened out in order subsequently to be anchored by means of the bolts 5, in this way, the pieces 6 and the wings 36 of the fixed upright 7 cannot be separated.

Referring to FIG. 1*b*, the reinforcing support 41 will be seen which is wedged against the centre rib 8 of the fixed upright 7. To make this possible, such rib 8 includes laterally two interlocking elements, the one, 42, a straight slot, perpendicular and towards the end of the rib 8, the other, a double turn, one parallel, the other perpendicular to the rib 8, with broken edge and notch 43 into which the reinforcing support 41 can be wedged after having inserted it at an angle and then pressed it down against the rib 8 and, in addition, fixed it longitudinally on the rib 8 by a bolt (not shown). Such reinforcing support 41 is more or less in the form of a fork which includes, on the one hand, at one end, a flat nose 44 and a rounded nose 45 on the other face, in such a way as to be able to be placed at an angle and subsequently straightened up in the slot 43 of the rib 8 and, on the other hand, and its back, a protrusion 46 on the right side which positions itself in the slot 42. In addition, this reinforcing support 40 extending beyond the rib 8 will make it possible to face the axis 29 of the release 18 in such a way as to act as a bearing for it : an aperture 47 being provided to this end. At the same time, this reinforcing support 41 will act as distance-piece between the ejector 33 and the rib 8. In this way, the reinforcing support 41 keeps the axis 29 of the release correctly meshed into the toothed rail 32 broached on to the batten 20 and guarantees smooth functioning of the different pieces causing the ladder to open.

It is understandable on the one hand, that the pieces 6 are provided at the level of each piece 2 anchored into the wall 1 and, on the other hand, that the reinforcing support for its part, is provided at the level of each release 18.

Moreover, as the respective interlocking of the different pieces 6 with the wings 36 and 41 and with the centre rib 8 is not achieved by presenting pieces 6 and 41 obliquely, not only do rounded edges have to be provided but also a certain clearance in one of the elements to be brought together, in the form of free space permitting one element to be introduced into the other. Such introduction not being achieved simply by presenting pieces 6 and 41 in parallel but on the contrary obliquely, then straightening them out by lateral pivoting and thus locking them one into the other. This does not prevent pieces 6 and 41 from playing their part.

Referring to FIG. 4, it will therefore be seen that the pieces 6 are fragments of complete sectional lengths, each provided with a vertical slot 35 into which can be slipped the small lateral wings 36 parallel to the plane of the facade of the fixed upright 7. Such pieces moreover, have two threaded perforations 51 (not shown) placed one beneath the other for insertion of the bolts 5.

Figure 1C:
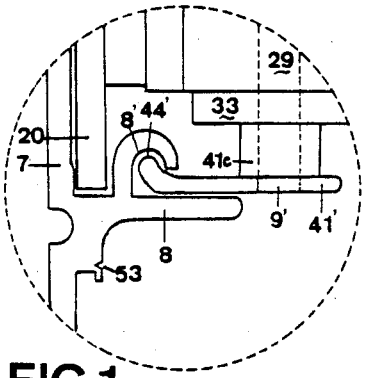
Figure 2:
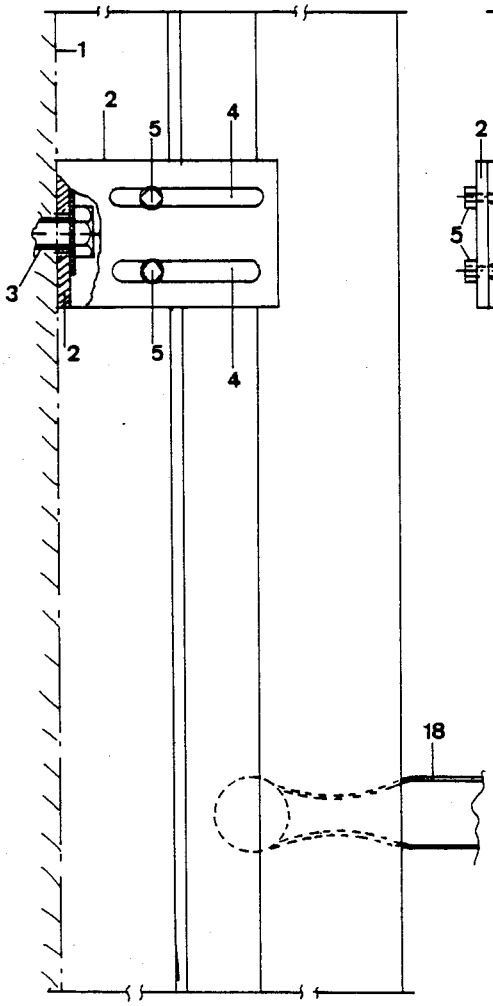
FIG. 2 is a scaled-down view, partly cut away, of the side of a caisson section.

In another preferred form of embodiment of the invention in accordance with FIGS. 1*a* and 1*c*, the reinforcing support 41 is replaced by the support 41', and the slot 42 is cancelled, which the slot 43 has been replaced by a groove 8' into which fits the nose 44' of the support 41'. The support 41' is placed horizontally in the groove 8′ and is then pivoted upwards, being subsequently held in place with the help of two notches made with a chisel on each side of the groove 8′. As already stated, the hole 9′ in the support 41′ acts as a bearing for the axis 29 of the release. This form of embodiment has the advantage of clearly improving the meshing of the pinion 31 in the toothed rail 32 by making the release more rigid when pressure is applied to the hand-grip 18 to operate it.

On the other hand, in accordance with this other form of embodiment of the invention, apart from the system of manual opening, an electrical system of opening the ladder can be designed using contact makers controlling a direct current reducing motor powered by a constant recharge battery. To this end, a groove 52 has been provided in the upright 7 where electric wiring can be inserted.

In order to avoid the lateral displacement of the supporting arms of the balancing springs (not shown) placed inside the rungs, and thus prevent deterioration of the latter, two V-shaped slots 53 have been provided on the upright 7.

This invention is not restricted to the forms of embodiment described above and making changes in them would not mean departing from it scope.

I claim:

1. Improvement to emergency ladders folding in one or more vertically successive sections of which each element is made up of two angle-metal uprights arranged with their inside surface opposite one another, of articulated rungs on the said uprights; uprights whose inside faces perpendicular to the plane of the ladder support two longitudinal ribs, situated towards the edge of the wing of the first upright and towards the angle of the second, each rib facing a rib of the other upright and provided, at regular intervals in the longitudinal direction, with facing perforations receiving pivots for articulating the rungs, characterized by the fact that the fixed angle-metal upright, that is the one to be placed on the facade side, comprises, on the one hand, on each side, outside and at the sides, a wing parallel to the plane of the facade; a wing over which are curved on each side, pieces having a notch which engages the end of such lateral wings, characterized by the fact that such lateral wings are shaped so as to be able to position themselves right into the groove (38) of the notch on each piece (6) which is fixed by means of one or more bolts at a desired point along the length of the respective parallel longitudinal slot(s) (4) with which each wing of a U-piece anchored to the facade is provided; anchoring piece enclosing and holding by its wings the fixed upright (7) by means of notched pieces (35) and, on the other hand, the fact that such said fixed upright (7), between its perpendicular wing on the facade and the adjacent rib, has a double slot (19) inside, of hammerhead shape, into which can be slipped the edges of a flat piece (20) of length identical to that of a ladder section, such said flat piece (20) in each section being made to connect successively one to the other in such manner as to ensure continuity and connection over the whole height of the ladder of the means of keeping it in the folded and unfolded positions, and by successive perforations, make it possible to broach a toothed rail (32) at determinate points and place a release (18) there, for example every 30 cm, points likewise determined on the lateral wing of the fixed upright (7), by successive perforations meant to receive a drilling gauge to effect perforations for fixing the support for the axis of the release.

2. Improvement to emergency folding ladders in accordance with claim 1, characterized by the fact that, in order to ensure smooth functioning of the succession of flat pieces (20), pinions (31) and toothed rails (32) permitting attachment, detachment and separation of the two uprights of the ladder, a reinforcing support (41) is provided which, by fitting into the centre rib opposite the perpendicular lateral wing of the fixed upright (7) which is fixed by screw or bolt, will be able to act as a bearing for pivoting the axis of the release, prevent deformation of the lateral wing of the fixed upright and therefore, maintain good meshing of the pinion (31) with the toothed rail (32).

3. Improvement to emergency folding ladders in accordance with claim 1, characterized by the fact that the U-piece (2) anchored by means of an extensible bolt (3) is provided at the back with an adjustment slot before being finally affixed to the wall and on each of its wings, with two longitudinal slots (4) through which pass the two bolts (5) maintaining at various points the pieces (6) in which the fixed angle-metal upright (7) of the ladder is maintained and, for example for reasons of expansion, can slide vertically, such upright having longitudinal ribs (8) in which are provided perforations (9) for the rung pivots, the slot on the U-piece (2) is off-centre in relation to the axis so as to allow maximum lateral displacement in order closely to align vertically all the expansion pieces (6) even if the anchoring bolt on the building has to be shifted laterally.

4. Improvement to emergency folding ladders in accordance with any one of the claims 1 or 2, characterized by the fact that the inside face of the fixed upright (7) includes, between the wing perpendicular to the face of the fixed upright (7) and the neighbouring rib (8), a double longitudinal slot (19) into which is slipped a flat piece (20) acting as a batten; a flat piece the height of which is identical to that of a section of the ladder, and a flat piece (20) which is connected, for example by means of a small plate and two screws to the flat pieces (20) of the sections above and below, if any, and by the fact that on such said flat piece (20) is fixed an attachment piece (21) and that the system is controlled by the releasing arm (18); an attachment piece (21) consisting of a U-section (22) with back turned towards the flat piece (20), through which is positioned an axis (23) bearing a bracket (24) turned towards the arm and pressed by a spring (25) into this position, and that, facing this attachment piece (21) forming an integral whole in the vertical plane with the fixed upright (7), is a piece (26) provided with a nose (27), fixed to the movable upright (10), a nose (27) which engages under the bracket (24) when the ladder is closed, and that such piece (26) is fixed in the centre rib (13) of the unfolding upright (10), the rear part (28) of such piece is vertically receding so that the nose (27) is more or less in the longitudinal axis of the flat piece (20).

5. Improvement to emergency folding ladders in accordance with any one of the claims 2 or 3, characterized by the fact that a releasing arm (18) is mounted at one end of an axis (29) placed in a support (30) fixed on the lateral wing of the upright (7); axis (29) passing through such upright and sustained at the other end by a reinforcing support (41) localized and laterally fixed by the notches (42) and (43) on the rib (8) and localized and fixed longitudinally by a bolt, and that on the axis (29) is fixed the control push-button (50) which acts upon the pin (51) on the pinion (31) causing the latter to turn, which forces the toothed rail (32) tailed into the plate (20) by means of two pins (32*a*) upwards and therefore the bracket (24) on the attachment piece (21) and, in order to compel the ladder to unfold, a longitudinal tilting (33) or ejector arm has likewise been placed on the axis (29) beyond the pinion (31) and controlled by the pin (51), and which, when its angle end (34) moves away from the flat piece (20), pushes against the outside face of the movable upright (10), and that, for all the attachment pieces (21) placed on the flat pieces (20) forming an integral whole, pieces (26) which are fixed on the movable upright (10), may be raised and thus detached before the tilting arm (33) forces the movable upright (10) to move away from the fixed upright (7), a curved slot (33*a*) has been made on the flat part of the tilting arm (33) allowing the pin (51) lodged in such slot to pivot through a few degrees before pulling the tilting arm (33) and causing the ladder to unfold over its whole height.

6. Improvement to emergency folding ladders in accordance with one of claims 1–3, characterized by the fact that the rib (8) has a curved part forming a groove (8′) into which fits the nose (44′) of the reinforcing support (41′) which is provided with a hole (9′), the reinforcing (41′) being held in place by a notch made on each side of the latter and by a cylindrical distance-piece (41*c*) with a borehole through which passes the axis (29) which lodges in the above-designated hole (9′), the distance-piece (41*c*) having the further function of avoiding the warping of the reinforcing support (41′).

7. Improvement to emergency folding ladders in accordance with one of claims 1–3, characterized by the fact that, when a hand-grip (18) is operated, it turns the respective pinion (31) which causes movement of the corresponding toothed rail (32) which is integrally connected with the flat piece (20) acting as a batten, flat piece (20) on which has been fixed another toothed rail at each floor, each toothed rail (32) placed on such flat piece (20) or batten acts upon its respective pinion (31) without nevertheless causing its corresponding axis (29) and hand-grip (18) to rotate, which has the consequence that the fact of operating the arm of the release is independent of the movement of the other arms of releases.

8. Improvement to emergency folding ladders in accordance with one of claims 1–3 characterized by the fact that a groove (52) has been installed in the upright (7) to insert the electric wiring connecting the different elements of the electric system for unfolding the ladder, just as two V-shaped slots (53) have been made on this same upright (7) whose function is to avoid lateral displacement of the support arms of balancing springs placed inside rungs and thus prevent deterioration of the latter.

9. Improvement to emergency folding ladders in accordance with one of claims 1–3, characterized by the fact that one or more electric contact-makers control a reducing motor powered by a constant recharge battery or other adequate electric supply, which operates the flat piece (20) or batten over its whole height and consequently the pinions and tilting levers of the other manual releases which would perhaps be placed on the ladder upright (7), even if the axes (29) and levers (18) of these are immobilized.

10. An emergency folding ladder, which comprises:

at least one vertical ladder section, the ladder section including a fixed upright member (7) and a movable upright member (10) positioned adjacent one another, the fixed upright member (7) including a pair of wings (36), each wing (36) extending outwardly from a lateral side of the upright member (7);

a plurality of rungs pivotally joined to and interposed between the fixed and movable upright members (7, 10);

a U-shaped member (2) adapted to be secured to a building facade in order to maintain the fixed upright member (7) in a vertical position, the U-shaped member (2) having a pair of wings in spaced apart relationship, each wing of the U-shaped member (2) including an elongated slot (4) formed therein and dimensioned to receive a bolt (5), the fixed upright member (7) being interposed between the wings of the U-shaped member (2); and a pair of notched pieces (6), the notched pieces being interposed between the lateral sides of the fixed upright member (7) and a corresponding wing of the U-shaped member (2), each notched piece (6) having formed therein a notch (37) dimensioned to receive a corresponding lateral wing (36) of the fixed upright member (7), and having an opening formed therein dimensioned to receive the bolt (5).

11. An emergency folding ladder, which comprises:

a pair of upright members;

means for mounting one of the upright members to a building facade, the mounting means including a pair of wings in spaced apart relationship, said one of the upright members being interposed between the wings, said one of the upright members including a pair of lateral wings (36) extending outwardly from lateral sides thereof; and a pair of notched pieces (6), each piece having a groove (38) formed therein, the notched pieces (6) being interposed between the lateral sides of said one upright member and the wings of the mounting means and engaging the lateral wings (36) of said one member, the lateral wings (36) being shaped so as to be able to position themselves into the grooves (38) of the notched pieces (6).

12. An emergency folding ladder, which comprises:

at least one vertical ladder section, the ladder section including a fixed upright member (7) and a movable upright member (10) positioned adjacent one another, the fixed upright member (7) including a first wing, a second wing extending perpendicularly to the first wing, and a rib (8) extending outwardly from the first wing, each of the second wing and the rib (8) having a slot (19) formed therein, the slots (19) being formed in the second wing and rib to face each other;

means for mounting the fixed upright member (7) to a building facade;

a plurality of rungs pivotally joined to and interposed between the fixed and movable upright members (7, 10);

a flat member (20) received by the slots (19) of the rib (8) and second wing and slidably movable within the slots; and means for effecting the slidable movement of the flat member (20), the movement effecting means including at least two ladder release assemblies, each ladder release assembly including a release arm (18) rotatably mounted to the fixed upright member (7), a pinion (31) coupled to the release arm and rotatable therewith, and a toothed rail (32) mounted to the flat piece (20) and engageable with the pinion (31), the ladder release assemblies being positioned on the fixed upright member (7) in a spaced apart relationship along the length of the upright member, each ladder release assembly acting independently of the other to effect the slidable movement of the flat member (20).

* * * * *